US009492705B2

(12) United States Patent
Hong

(10) Patent No.: US 9,492,705 B2
(45) Date of Patent: Nov. 15, 2016

(54) MULTIFUNCTIONAL SLIDING EXERCISE MACHINE

(71) Applicant: Bong-Fill Hong, Ulsan (KR)

(72) Inventor: Bong-Fill Hong, Ulsan (KR)

( * ) Notice: Subject to any disclaimer, the term of this patent is extended or adjusted under 35 U.S.C. 154(b) by 0 days.

(21) Appl. No.: 14/437,680

(22) PCT Filed: Apr. 17, 2014

(86) PCT No.: PCT/KR2014/003331

§ 371 (c)(1),
(2) Date: Apr. 22, 2015

(87) PCT Pub. No.: WO2014/181977

PCT Pub. Date: Nov. 13, 2014

(65) Prior Publication Data

US 2016/0067545 A1 Mar. 10, 2016

(30) Foreign Application Priority Data

May 10, 2013 (KR) ..... 10-2013-0052868

(51) Int. Cl.
*A63B 21/00* (2006.01)
*A63B 22/20* (2006.01)
(Continued)

(52) U.S. Cl.
CPC ..... *A63B 22/203* (2013.01); *A63B 21/00069* (2013.01); *A63B 21/0442* (2013.01);
(Continued)

(58) Field of Classification Search
CPC ..... A63B 21/00069; A63B 21/00072; A63B 21/0615; A63B 21/0618; A63B 21/068; A63B 21/22; A63B 21/225; A63B 21/227; A63B 21/4033; A63B 21/4034; A63B 21/4035; A63B 21/4045; A63B 21/4047; A63B 21/4049; A63B 22/0002; A63B 22/0005; A63B 22/0015; A63B 22/0017; A63B 22/0046; A63B 22/0087; A63B 22/20; A63B 22/201; A63B 22/203; A63B 2022/0028; A63B 2022/003; A63B 2022/0033; A63B 2022/0035; A63B 23/0205; A63B 23/0211; A63B 23/0216; A63B 23/0222; A63B 23/035; A63B 23/03508; A63B 23/03516; A63B 23/03525; A63B 23/03533; A63B 23/03541; A63B 23/0355; A63B 23/03558; A63B 23/03575; A63B 23/04; A63B 23/0405; A63B 23/0417; A63B 23/0482; A63B 23/0488; A63B 23/0494; A63B 23/12; A63B 23/1209; A63B 23/1236; A63B 23/1245; A63B 23/1281; A63B 2023/0411; A63B 69/0022; A63B 69/182; A63B 2208/0204; A63B 2208/0209; A63B 2208/0214; A63B 2208/0219; A63B 2208/0223; A63B 2208/0238; A63B 2208/0242; A63B 2208/0247; A63B 2208/0252; A63B 2208/0257; A63B 2208/0295; A63B 2210/50; A63B 2225/09; A63B 2225/093; A63B 2225/10; A63B 2244/18; A63B 2244/19
See application file for complete search history.

(56) References Cited

U.S. PATENT DOCUMENTS 3,559,986 A * 2/1971 Ehrmantraut ..... A63B 23/0417 482/132

(Continued)

FOREIGN PATENT DOCUMENTS

JP 06-091017 A 4/1994
JP 3160067 U 6/2010

(Continued)

OTHER PUBLICATIONS

International Search Report for PCT/KR2014/003331 and having a mailing date of Jul. 8, 2014.

(Continued)

*Primary Examiner* — Oren Ginsberg
*Assistant Examiner* — Gary D Urbiel Goldner
(74) *Attorney, Agent, or Firm* — Flener IP Law, LLC; Zareefa B. Flener

(57) ABSTRACT

A multifunctional sliding exercise machine comprises: a pair of bodies having a symmetric shape, each body being hinge-coupled at one end; a rotating shaft of which one end and another end are rotatably coupled to a hinge portion, respectively, to which the pair of bodies are hinge-coupled; and a pair of slide plates slidably coupled to respective upper surfaces of the pair of bodies.

7 Claims, 6 Drawing Sheets

(51) Int. Cl.

| | |
|---|---|
| ***A63B 21/04*** | (2006.01) |
| ***A63B 21/055*** | (2006.01) |
| ***A63B 21/22*** | (2006.01) |
| ***A63B 23/035*** | (2006.01) |
| *A63B 22/00* | (2006.01) |
| *A63B 23/02* | (2006.01) |
| *A63B 23/04* | (2006.01) |
| *A63B 23/12* | (2006.01) |

(52) U.S. Cl.

CPC ..... *A63B21/0552* (2013.01); *A63B 21/22* (2013.01); *A63B 21/4034* (2015.10); *A63B 21/4035* (2015.10); *A63B 23/0355* (2013.01); *A63B 22/0023* (2013.01); *A63B 22/0089* (2013.01); *A63B 23/0216* (2013.01); *A63B 23/0222* (2013.01); *A63B 23/0488* (2013.01); *A63B 23/1209* (2013.01); *A63B 23/1236* (2013.01); *A63B 2022/0038* (2013.01); *A63B 2022/0041* (2013.01); *A63B 2208/0204* (2013.01); *A63B 2208/0219* (2013.01); *A63B 2208/0252* (2013.01); *A63B 2210/50* (2013.01)

(56) References Cited

U.S. PATENT DOCUMENTS

| | | | | |
|---|---|---|---|---|
| 4,506,884 | A * | 3/1985 | Hankin | A63B 22/203 482/131 |
| 4,781,372 | A * | 11/1988 | McCormack | A63B 23/03533 482/104 |
| 4,915,373 | A * | 4/1990 | Walker | A63B 21/012 482/114 |
| 5,328,427 | A * | 7/1994 | Sleamaker | A63B 21/4045 482/110 |
| 5,749,811 | A * | 5/1998 | Wilson | A63B 69/18 434/253 |
| 6,231,483 | B1 | 5/2001 | Phillips | |
| 6,569,064 | B1 * | 5/2003 | Loane | A63B 21/154 482/146 |
| 6,942,605 | B1 | 9/2005 | Sukhovitsky | |
| 7,901,332 | B1 * | 3/2011 | Wen | A63B 22/0058 482/51 |
| 2001/0036885 | A1 * | 11/2001 | Castellot, Jr. | A63B 21/012 482/79 |
| 2002/0049122 | A1 * | 4/2002 | Mercado | A63B 21/00181 482/57 |
| 2004/0014569 | A1 * | 1/2004 | Loane | A63B 21/4007 482/70 |
| 2004/0132582 | A1 * | 7/2004 | Park | A63B 23/20 482/51 |
| 2004/0214693 | A1 * | 10/2004 | Piaget | A63B 22/025 482/52 |
| 2004/0241631 | A1 * | 12/2004 | Nizamuddin | A63B 21/157 434/253 |
| 2006/0223681 | A1 * | 10/2006 | Loane | A63B 21/4011 482/71 |
| 2007/0287605 | A1 | 12/2007 | Mylrea et al. | |
| 2009/0176631 | A1 * | 7/2009 | Blessing | A63B 22/0061 482/71 |
| 2009/0298657 | A1 * | 12/2009 | Potok | A63B 23/1245 482/141 |
| 2010/0286575 | A1 * | 11/2010 | Ochi | A61H 1/005 601/5 |
| 2011/0039667 | A1 * | 2/2011 | Teng | A63B 23/03541 482/142 |
| 2011/0152731 | A1 * | 6/2011 | Ochi | A61H 1/005 601/5 |
| 2014/0031175 | A1 * | 1/2014 | Peralo | A61H 1/02 482/66 |
| 2014/0329645 | A1 * | 11/2014 | De Biasi | A63B 69/0022 482/70 |

FOREIGN PATENT DOCUMENTS

| | | |
|---|---|---|
| KR | 10-2009004831 | 12/2010 |
| WO | WO 2010/104248 A1 | 9/2010 |
| WO | WO 2010/140808 A2 | 12/2012 |

OTHER PUBLICATIONS

English Translation of the International Search Report for PCT/KR2014/003331, having a mailing date of Jul. 8, 2014.

Written Opinion of the International Search Authority for PCT/KR2014/003331, having a mailing date of Jul. 8, 2014.

Office Action in priority application KR 10-2013-0052868, issued by the KIPO on Aug. 7, 2014.

KR 10-2013-0052868, Decision to Grant, issued by KIPO on Nov. 11, 2014.

* cited by examiner

MULTIFUNCTIONAL SLIDING EXERCISE MACHINE

CROSS-REFERENCE TO RELATED APPLICATION

This Application is a Section 371 National Stage Application of International Application No. PCT/KR2014/003331, filed on Apr. 17, 2014, the contents of which is hereby incorporated by reference in its entirety.

TECHNICAL FIELD

The present disclosure relates to a multifunctional sliding exercise machine, and more particularly, to such a multifunctional sliding exercise machine, which enables users to perform a muscle strengthening exercise without constraints of place, time, and space.

BACKGROUND ART

In recent years, along with the improvement of the quality of life, people have a great interest in health and thus the portions of the population who does exercise or leisure activities are increasing continuously. In particular, the improvement of dietary habits contributes to an increase in the number of obese people. As a result, an interest in exercises is further increasing and thus a lot of sports facilities are constructed where a user can enjoy physical fitness, yoga and the like.

However, in the case where the general public does a health workout, it is not easy for them to carry exercise equipment needed to do the health workout due to its weight. For this reason, the people have to do the health workout only in a specific space, and thus they cannot help but do a health workout to promote health only in a limited manner.

Therefore, recently, there is a trend toward the development of a wide variety of auxiliary exercise machines that makes it easy for users to carry and enables them to do a health workout.

However, the conventional various auxiliary exercise machines have been developed to intensively perform an exercise on a user's specific bodily region, but not a whole-body workout of the user, and thus they are relatively good in terms of convenience and portability but are insignificant in terms of the whole-body exercise effect.

In addition, the conventional various auxiliary exercise machines entails a problem in that because they are limited in the kind of an exercise which a user can do, the user cannot help but do the same exercise repeatedly, which makes he or her to easily get tired of the exercise or makes it not easy for him or her to troubleshoot when a failure occurs.

DISCLOSURE

Technical Problem

Accordingly, the present disclosure has been made to solve the aforementioned problems occurring in the prior art, and it is an object of the present invention to provide a multifunctional sliding exercise machine, which enables users to perform a variety of exercises without constraints of place, time, and space so that they can perform an exercise on various muscular regions of their bodies.

Technical Solution

To achieve the above and other objects, in accordance with the present disclosure, there is provided a multifunctional sliding exercise machine including:

a pair of bodies which is formed in a symmetric shape and each of which is hinge-coupled at one end thereof;

a rotary shaft rotatably coupled at one end and the other end thereof to a pair of hinge units to which the pair of bodies is hinge-coupled; and a pair of slide plates slidably coupled to the top surfaces of the pair of bodies.

Each of the pair of bodies may include a first frame including a pair of connection brackets at both ends thereof, a pair of rails coupled at one ends thereof to one side of the first frame so as to be spaced apart from each other by a predetermined distance, and a second frame coupled to the other ends of the pair of the rails.

A pair of guides may be disposed at both sides of each of the pair of bodies in such a manner as to be coupled at one ends thereof to a side of the first frame and coupled at the other ends thereof to a side of the second frame.

The pair of guides may include a pair of extending sections formed at one ends thereof, a support shaft may be disposed between the pair of extending sections in such a manner as to be penetratingly coupled at one end and the other end thereof to the extending extensions, and a pair of rotating rollers may be coupled to predetermined lengthwise positions of the support shaft in such a manner as to be spaced apart from each other by a predetermined distance.

A height adjustment support may be installed at the pair of extending sections.

The height adjustment support may include a pair of holders rotatably coupled to both ends of the support shaft and a connection bar configured to interconnect the pair of holders, each of the pair of holders may be formed in an isosceles triangular shape, any one of three vertexes of each holder may be coupled to the support shaft, and a rotating roller may be coupled to any one of the remaining two vertexes of each holder.

Each of the pair of guides may be formed in a shape in which one or more inwardly convex sections and one or more outwardly convex sections are alternately arranged with each other along the lengthwise direction of the guide.

The rotary shaft may include a pair of support plates eccentrically coupled to the pair of hinge units, respectively, and a connection plate configured to interconnect the pair of support plates, and the connection plate may be formed in a shape in which both sides thereof are curved in a mutually symmetrical manner.

A distance adjustment assembly may be disposed at a predetermined lengthwise position of each of the pair of bodies to adjust the sliding distance of the pair of slid plates.

The distance adjustment assembly may include a stopper block coupled at one end thereof to a predetermined position of one side of the first frame and coupled at the other end thereof to a predetermined position of one side of the second frame, and a stopper slidably coupled to any one of the pair of rails so that the stopper is inserted into any one of a plurality of stopper grooves formed on the top surface of the stopper block so as to be spaced apart from each other at predetermined intervals along the lengthwise direction of the stopper block to adjust the sliding distance of the slide plates.

Each of the slide plates may include a pair of movable members slidably coupled to the pair of rails and a plate coupled to the top surfaces of the pair of movable members, and the plate may include first and second handles disposed at widthwise both sides thereof so as to be opposed to each other and a plurality of incised grooves formed at both sides of thereof, in which the first and second handles are disposed, so as to allow the user to grip the first and second handles.

The stopper may include a seating protrusion formed on a side surface thereof so as to confront the movable member, and the movable member may include a seating hole formed therein so as to confront the stopper and a retaining step formed on the inner peripheral surface of the seating hole so as to suppress an additional advance of the seating protrusion inserted into the seating hole. In addition, an elastic part may be mounted around the seating protrusion so that an impact caused by the collision between the retaining step and the seating protrusion is reduced.

Advantageous Effect

The multifunctional sliding exercise machine in accordance with an embodiment of the present invention as constructed above has the advantageous effects in that users perform a variety of exercises without constraints of place, time, and space so that they can perform an exercise on various muscular regions of their bodies.

BRIEF DESCRIPTION OF THE DRAWINGS

The above objects, other features and advantages of the present disclosure will become more apparent by describing the preferred embodiments thereof with reference to the accompanying drawings, in which.

EXPLANATION ON REFERENCE NUMERALS OF MAIN ELEMENTS IN THE DRAWINGS

Figure 1A:
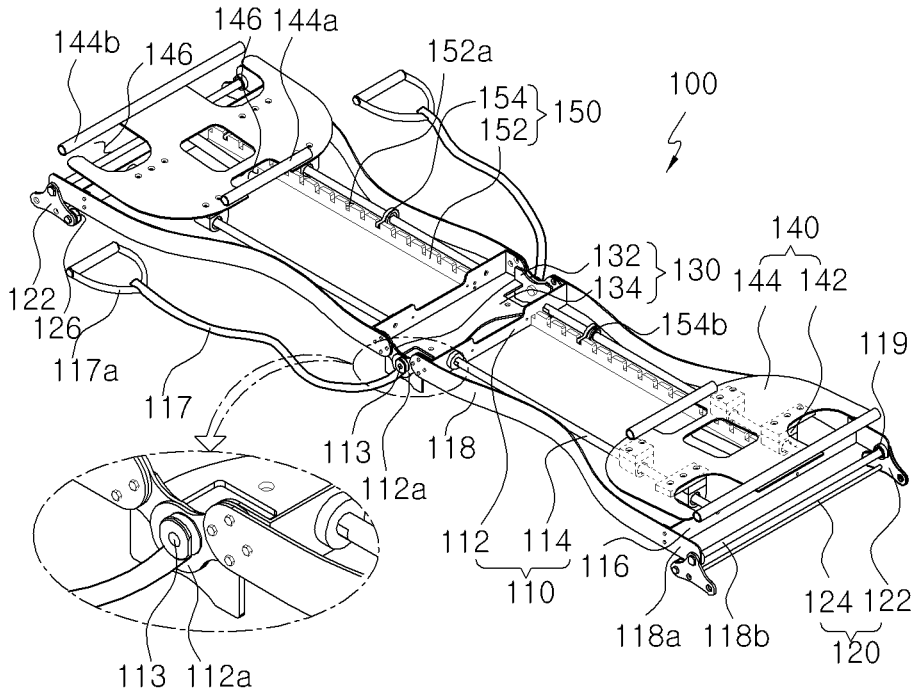
FIGS. 1*a* and 1*b* are assembled perspective views showing a multifunctional sliding exercise machine in accordance with an embodiment of the present disclosure.

110: a pair of bodies
134: connection plate
112: first frame
140: a pair of slide plates
112*a*: connection bracket
142: a pair of movable members
113: hinge unit
142*a*: seating hole
114: a pair of rails
142*b*: retaining step
115: a pair of permanent magnets
144: plate
116: second frame
144*a*, 144*b*: first and second handles
117: elastic element
146: incised groove
117*a*: handle
150: distance adjustment assembly
118: a pair of guides
152: stopper block
118*a*: extending section
152*a*: stopper groove
118*b*: support shaft
154: stopper
119: rotating roller
154*a*: seating protrusion
120: height adjustment support
154*b*: spring washer
122: a pair of holders
124: connection bar
126: rotating roller
130: rotary shaft
132: a pair of support plates

PREFERRED EMBODIMENTS OF THE INVENTION

Hereinafter, the preferred embodiments of the present disclosure will be described in detail with reference to the accompanying drawings. However, the embodiments are for illustrative purposes only and are not intended to limit the scope of the invention. For the sake of a clearer understanding of the present disclosure, the thickness of lines or the size of constituent elements shown in the drawings may be illustrated exaggeratingly for the clarity and convenience of description.

Also, the terms of constituent elements, which will be described hereinafter, are defined in consideration of their functions in the present disclosure and may be changed according to the intention of a user or an operator, or according to the custom. Accordingly, definitions of these terms must be based on the overall description herein.

Figure 1B:
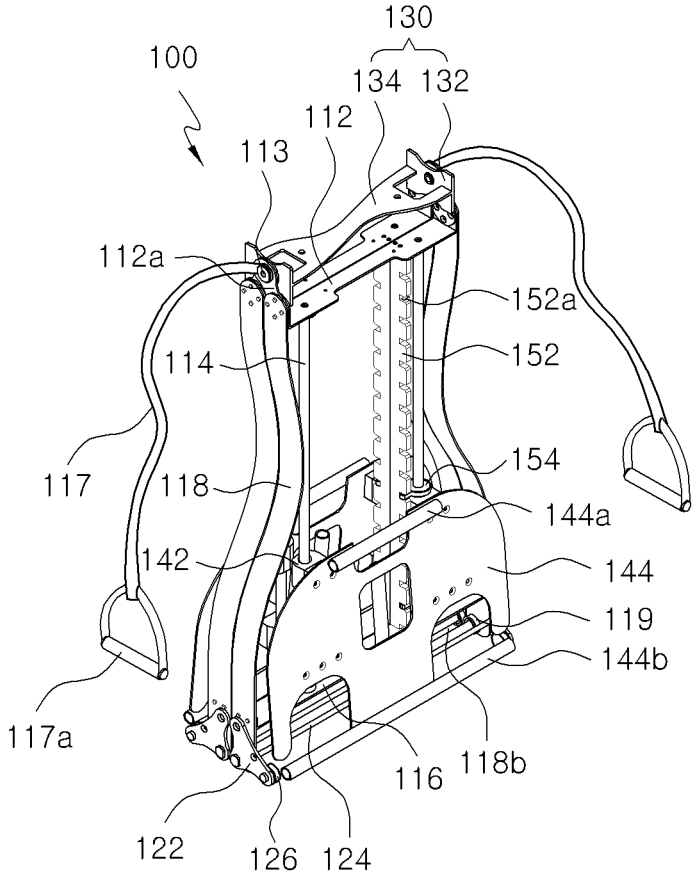
Figure 2:
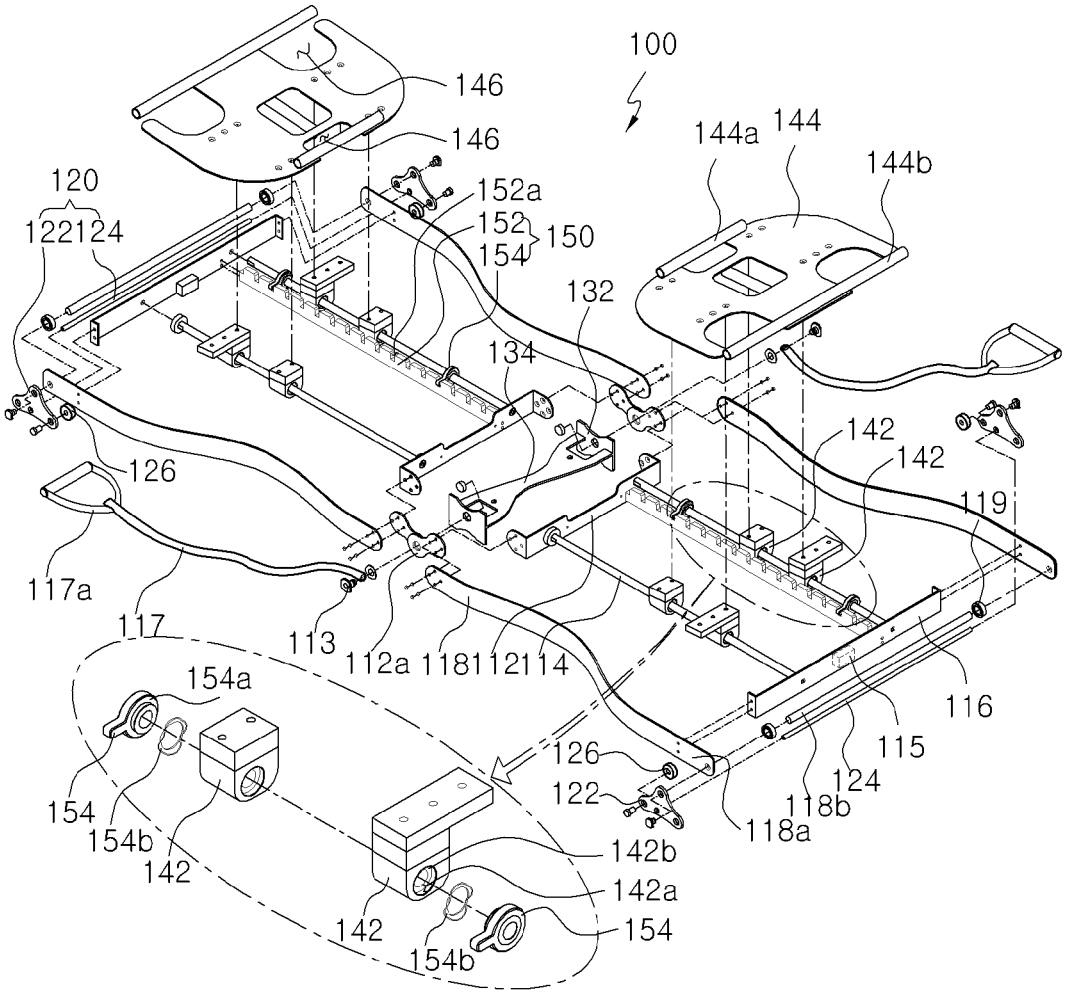
FIG. 2 is a perspective view showing a multifunctional sliding exercise machine in accordance with an embodiment of the present disclosure.
Figure 3:
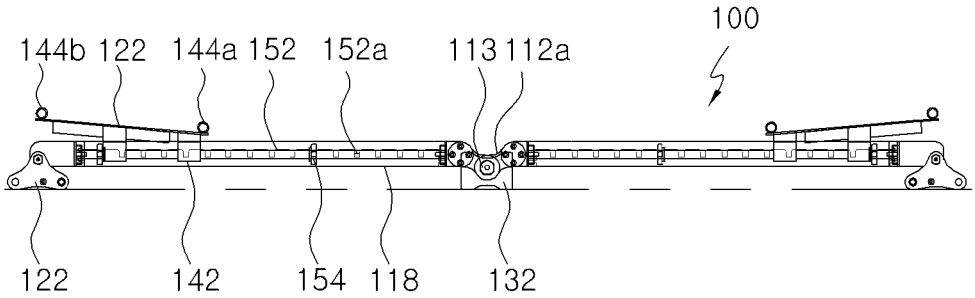
FIG. 3 is a side view showing a multifunctional sliding exercise machine in accordance with an embodiment of the present disclosure.
Figure 4:
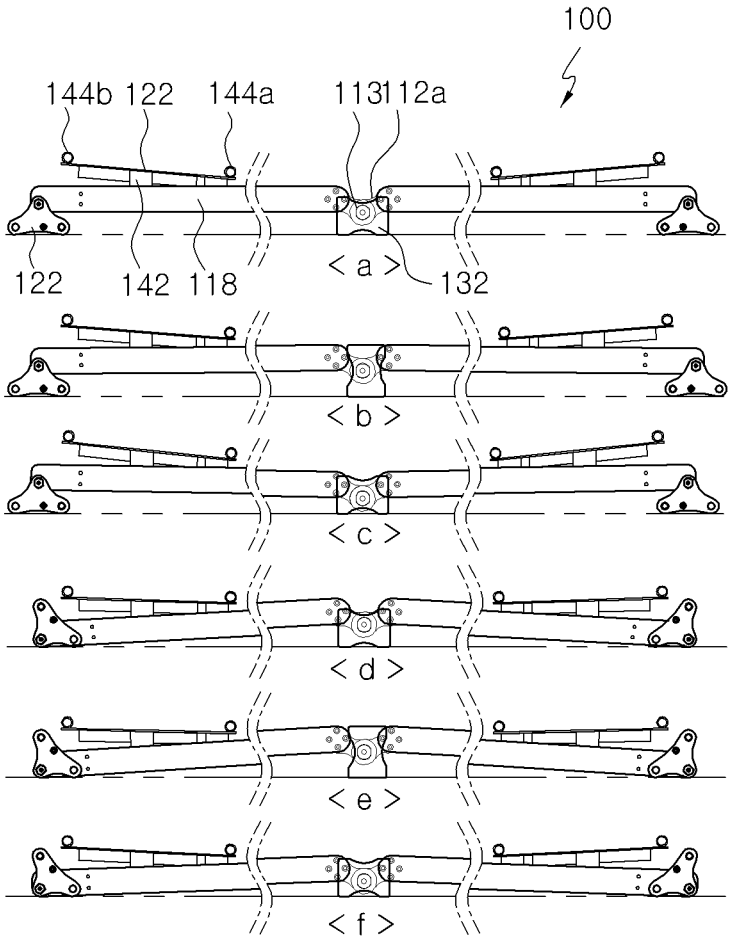
FIG. 4 is a schematic view showing a state in which the height of multifunctional sliding exercise machine in accordance with an embodiment of the present disclosure is adjusted by a rotary shaft and a height adjustment support shown in FIG. 2.
Figure 5A:
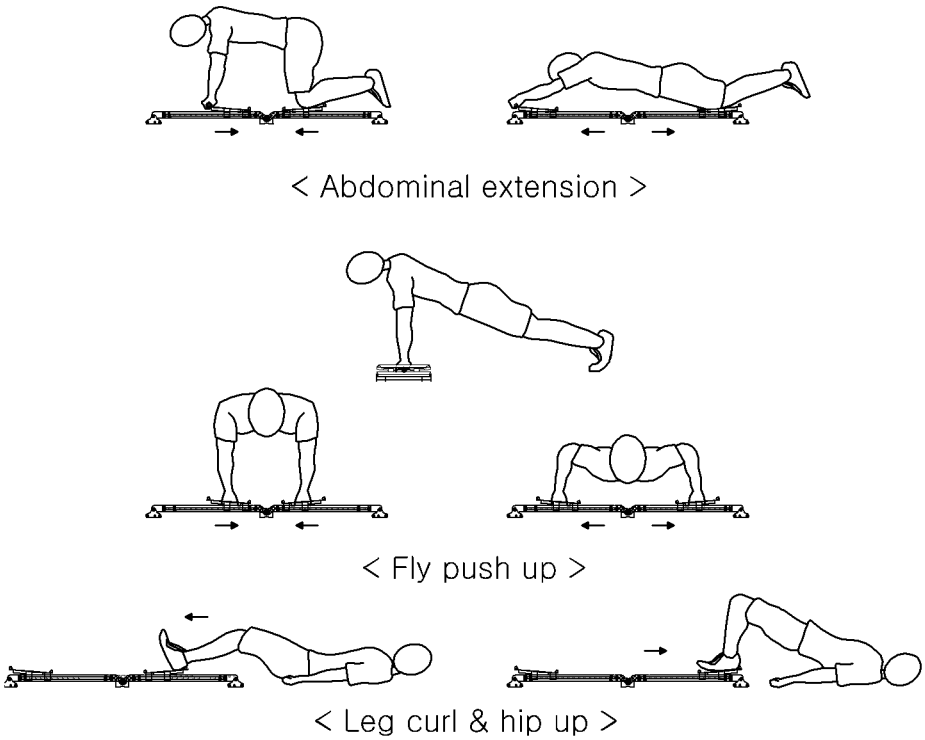
FIGS. 5*a* and 5*b* are views showing the use state of a multifunctional sliding exercise machine in accordance with an embodiment of the present disclosure.
Figure 5B:
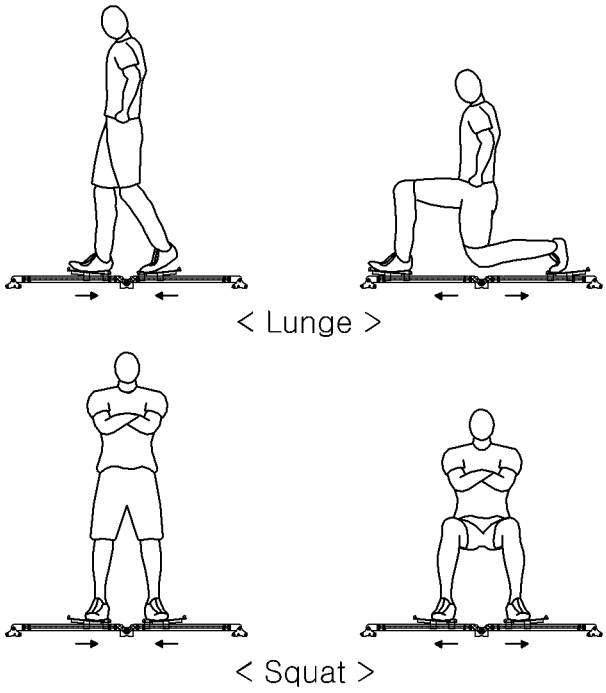

FIGS. 1*a* and 1*b* are assembled perspective views showing a multifunctional sliding exercise machine in accordance with an embodiment of the present disclosure, FIG. 2 is an perspective view showing a multifunctional sliding exercise machine in accordance with an embodiment of the present disclosure, FIG. 3 is a side view showing a multifunctional sliding exercise machine in accordance with an embodiment of the present disclosure, FIG. 4 is a schematic view showing a state in which the height of multifunctional sliding exercise machine in accordance with an embodiment of the present disclosure is adjusted by a rotary shaft and a height adjustment support shown in FIG. 2, and FIGS. 5*a* and 5*b* are views showing the use state of a multifunctional sliding exercise machine in accordance with an embodiment of the present disclosure.

Referring to FIGS. 1*a* to 5*b*, a multifunctional sliding exercise machine 100 in accordance with an embodiment of the present disclosure includes a pair of bodies 110, a rotary shaft 130, and a pair of slide plates 140.

The pair of bodies 110 is formed in a symmetric shape and each of the pair of bodies 110 is hinge-coupled at one end thereof.

Each of the pair of bodies 110 includes a first frame 112 including a pair of connection brackets 112*a* at both ends thereof, a pair of rails 114 coupled at one ends thereof to one side of the first frame 112 so as to be spaced apart from each other by a predetermined distance, and a second frame 116 coupled to the other ends of the pair of the rails 114.

In addition, a pair of guides 118 is disposed at both sides of each of the pair of bodies 110 in such a manner as to be coupled at one ends thereof to a side of the first frame 112 and coupled at the other ends thereof to a side of the second frame 116.

The pair of guides 118 has an effect on the outer appearance of a product and plays an important role in rigidity of the entire structure. Thus, each of the guides 118 is preferably not formed in a linear shape, but is formed in a shape in which one or more inwardly convex sections and one or more outwardly convex sections are alternately arranged with each other along the lengthwise direction of the guides 118.

In this case, the pair of guides 118 includes a pair of extending sections 118*a* formed at one ends thereof, and a support shaft 118*b* is disposed between the pair of extending sections 118*a* in such a manner as to be penetratingly coupled at one end and the other end thereof to the extending extensions 118*a*.

A pair of rotating rollers 119 is coupled to predetermined lengthwise positions of the support shaft 118*b* in such a manner as to be spaced apart from each other by a predetermined distance so that one side of each of the rotating rollers 119 abuts against each of the extending sections 118*a*. The pair of rotating rollers 119 serves as moving wheels when a user desires to move the multifunctional sliding exercise machine 100 to another place after using it.

A height adjustment support 120 is installed at the pair of extending sections 118*a* so as to adjust the height of the pair of bodies 110. The height adjustment support 120 includes a pair of holders 122 rotatably coupled to both ends of the support shaft 119*b* and a connection bar 124 configured to interconnect the pair of holders 122.

Herein, each of the pair of holders 122 is formed in an isosceles triangular shape, any one of three vertexes of each holder 122 is coupled to the support shaft 118*b*, and a rotating roller 126 is coupled to any one of the remaining two vertexes of each holder 122. In this case, the rotating roller 126 performs the same function as that of the rotating roller 119 coupled to the support shaft 118*b*.

Further, the sides interconnecting three vertexes of each of the holders 122 are preferably formed in a curved shape. This is to prevent the sides of the holders 122 from colliding with each other to cause interference to occur when a user desires to store the pair of bodies 110 with them folded after the use of the multifunctional sliding exercise machine 100 and is to prevent the sides of the pair of holders 122 from abutting against the ground surface when the user desires to move the pair of bodies 110 to another place with them folded.

In addition, a pair of permanent magnets 115 for applying a magnetic force to each other is preferably disposed at predetermined lengthwise positions of one sides of the first frame 112 and the second frame 116 so as to confront each other. This is to maintain the pair of bodies in a state of being folded when the pair of bodies has been folded.

Meanwhile, a pair of elastic elements 117 each having a handle 117*a* formed at an end thereof is disposed at a pair of hinge units 113 to which the pair of bodies is hinge-coupled so that a user can do an exercise after sitting on a pair of slide plates 140 which will be described later and then gripping the handles 117*a* coupled to ends of a pair of elastic elements 117.

In this case, any material can be used as the elastic element 117 as long as it has elasticity, such as a rubber band, a spring or the like.

The rotary shaft 130 is rotatably coupled at one end and the other end thereof to the hinge units 113 to which the pair of bodies 110 is hinge-coupled so that the height of the hinge unit 113 can be adjusted.

In addition, when the user lifts the rotary shaft 130 with him or her gripping the rotary shaft 130, the pair of bodies 110 is folded.

The rotary shaft 130 includes a pair of support plates 132 eccentrically coupled to the pair of hinge units 113, respectively, and a connection plate 134 that interconnects the pair of support plates 132. The connection plate 134 is preferably formed in a shape in which both sides thereof are curved in a mutually symmetrical manner. This is to allow the user to easily grip the rotary shaft 130.

Here, a method for adjusting the height of the hinge units 113 hinge-coupled to the pair of bodies 110 is performed such that when the user rotates the connection plate 134 with him or her gripping it, the pair of support plates 132 eccentrically coupled to the pair of hinge units is rotated so that the height of the hinge units 113 is changed depending on a surface of the hinge units, which abuts against the ground surface.

In other words, the change of the height of the pair of bodies 110 makes different the inclined angle at which the pair of slide plates 140 slidably coupled to the pair of bodies 110 is slidably moved so that the exercise strength can be increased or decreased.

A pair of slide plates 140 is slidably coupled to the top surfaces of the pair of bodies 110 so that a user can do various exercises, i.e., abdominal extension, fly push up, lunge, squat, leg curl, and hip up using the pair of slide plates 140.

The pair of slide plates 140 includes a pair of movable members 142 slidably coupled to the pair of rails 114 and a plate 144 coupled to the top surfaces of the pair of movable members 142.

Herein, preferably, the plate 144 includes first and second handles 144*a* and 144*b* disposed at widthwise both sides thereof so as to be opposed to each other, and a plurality of incised grooves 146 formed at both sides of thereof, in which the first and second handles 144*a* and 144*b* are disposed, so as to allow the user to grip the first and second handles 144*a* and 144*b*.

Further, the sliding distance of the pair of slid plates 140 is adjusted by a distance adjustment assembly 150 disposed at a predetermined lengthwise position of each of the pair of bodies 110. In other words, the user can adjust the sliding distance of the pair of slide plates 140 so as to fit his or her body.

The distance adjustment assembly 150 includes a stopper block 152 coupled at one end thereof to a predetermined position of one side of the first frame 112 and coupled at the other end thereof to a predetermined position of one side of the second frame 116, and a stopper 154 slidably coupled to any one of the pair of rails 114 so that the stopper 154 is inserted into any one of a plurality of stopper grooves 152*a* formed on the top surface of the stopper block 152 so as to be spaced apart from each other at predetermined intervals along the lengthwise direction of the stopper block to adjust the sliding distance of the slide plates 140.

In this case, the sliding distance of the slide plates can be adjusted by the collision the movable member 142 with the stopper 154 along the rail 114 with the stopper 154 and the movable member 142 confronting each other. The inventive multifunctional sliding exercise machine is preferably configured such that the user's body can be prevented from being injured by an impact due to the collision between the stopper 154 and the movable member 142.

To this end, the stopper 154 includes a seating protrusion 154*a* formed on a side surface thereof so as to confront the movable member 142, and the movable member 142 includes a seating hole 142*a* formed therein so as to confront the stopper 154 so that the seating protrusion 154*a* is inserted into the seating hole 142*a* and a retaining step 142*b* formed on the inner peripheral surface of the seating hole 142*a* so as to suppress an additional advance of the seating protrusion 154 inserted into the seating hole 142*a*. An elastic part such as a spring washer 154*b* or a rubber ring (not shown) is mounted around the seating protrusion 154*a*. By virtue of this configuration, an impact caused by the collision between the retaining step 142*b* and the seating protrusion 154*a* can be reduced.

Hereinafter, the operation of the multifunctional sliding exercise machine in accordance with an embodiment of the present disclosure as constructed above will be described.

First, a user puts the pair of bodies 110 on the ground surface with it unfolded, and then adjusts the sliding distance of the pair of slide plates 140 through the distance adjustment means 150 to fit his or her body, i.e., the lengths of two arms and two legs of the user.

Thereafter, the user can do various exercises such as abdominal extension, fly push up, lunge, squat, leg curl, and hip up as shown in FIGS. 5*a* and 5*b* after placing his both feet on the plate 144 of each of pair of the slide plates 140 or gripping the first and second handles 144*a* and 144*b* disposed at the plate 144 of each slide plate 140.

Subsequently, the user folds the pair of bodies 110 and then moves the multifunctional sliding exercise machine 100 to a place of storage after finishing the exercise.

Thus, the multifunctional sliding exercise machine in accordance with an embodiment of the present disclosure enables users to effectively perform a variety of exercises without constraints of place, time, and space so that they can perform an exercise on various muscular regions of their bodies.

In addition, the users can do a variety of exercises to fit their physical sizes and can easily store and carry the multifunctional sliding exercise machine.

While the present invention has been described in connection with the specific embodiments illustrated in the drawings, they are merely illustrative, and the invention is not limited to these embodiments. It is to be understood that various equivalent modifications and variations of the embodiments can be made by a person having an ordinary skill in the art without departing from the spirit and scope of the present invention. Therefore, the true technical scope of the present invention should not be defined by the above-mentioned embodiments but should be defined by the appended claims and equivalents thereof.

INDUSTRIAL APPLICABILITY

In accordance with the multifunctional sliding exercise machine of the present disclosure, users can perform a muscle strengthening exercise without constraints of place, time, and space.

What is claimed is:

1. A multifunctional sliding exercise machine comprising: a pair of bodies which is formed in a symmetric shape and each body of the pair of bodies being hinge-coupled at one end thereof; a rotary shaft rotatably coupled at one end and another end thereof, respectively, to a pair of hinge units to which each body of the pair of bodies is hinge-coupled; and a pair of slide plates slidably coupled to respective top surfaces of each body of the pair of bodies; wherein each body of the pair of bodies includes a first frame including a pair of connection brackets respectively at each end thereof, a pair of rails, each rail being coupled at one end thereof to one side of the first frame so as to be spaced apart from each other by a predetermined distance, and a second frame coupled to another end of each rail of the pair of the rails; wherein a pair of guides is disposed at each body of the pair of bodies whereby each guide of the pair of guides is disposed at each of two sides of each body of the pair of bodies in such a manner as to be coupled at one end thereof to a side of the first frame and coupled at another end thereof to a side of the second frame; wherein each pair of guides respective to each body comprises a pair of extending sections formed at one end thereof, a support shaft is disposed between the pair of extending sections in such a manner as to be penetratingly coupled at one end and another end thereof to the pair of extending extensions, and a pair of rotating rollers is coupled to predetermined lengthwise positions of the support shaft in such a manner as to be spaced apart from each other by a predetermined distance; wherein a height adjustment support is installed at the pair of extending sections respective to each body of the pair of bodies; wherein the height adjustment support comprises: a pair of holders, one holder of which being rotatably coupled to the one end of the support shaft and the other holder of which being rotatably coupled to the another end of the support shaft; and a connection bar configured to interconnect the pair of holders; and wherein each holder of the pair of holders is formed in an isosceles triangular shape, any one of three vertices of each holder is coupled to the support shaft, and a rotating roller is coupled to any one of the remaining two vertices of each holder.

2. The multifunctional sliding exercise machine according to claim 1, wherein each of the pair of guides is formed in a shape in which one or more inwardly convex sections and one or more outwardly convex sections are alternately arranged with each other along the lengthwise direction of the respective pair of guides.

3. The multifunctional sliding exercise machine according to claim 1, wherein the rotary shaft comprises a pair of support plates eccentrically coupled to the pair of hinge units, respectively, and a connection plate configured to interconnect the pair of support plates, and wherein the connection plate is formed in a shape in which both sides thereof are curved in a mutually symmetrical manner.

4. The multifunctional sliding exercise machine according to claim 1, wherein a distance adjustment assembly is disposed at a predetermined lengthwise position of each of the pair of bodies to adjust a sliding distance of the pair of slid plates.

5. The multifunctional sliding exercise machine according to claim 4, wherein the distance adjustment assembly respective to each body of the pair of the bodies comprises a stopper block coupled at one end thereof to a predetermined position of one side of the first frame and coupled at another end thereof to a predetermined position of one side of the second frame, and a stopper slidably coupled to any one rail of the pair of rails so that the stopper is inserted into any one of a plurality of stopper grooves formed on a top surface of the stopper block so as to be spaced apart from each other at predetermined intervals along a lengthwise direction of the stopper block to adjust the sliding distance of the pair of slide plates.

6. The multifunctional sliding exercise machine according to claim 5, wherein each of the slide plates comprises a pair of movable members slidably coupled to each rail of the pair of rails and a plate coupled to top surfaces of each pair of movable members, and wherein the plate comprises: first and second handles disposed at widthwise sides thereof so as to be opposed to each other; and a plurality of incised grooves formed at the widthwise sides of thereof at which the first and second handles are disposed, so as to allow the user to grip the first and second handles.

7. The multifunctional sliding exercise machine according to claim 6, wherein the stopper comprises a seating protrusion formed on a side surface thereof so as to confront one of the movable members, and the one of the movable members comprises: a seating hole formed therein so as to confront the stopper; and a retaining step formed on an inner peripheral surface of the seating hole so as to suppress an additional advance of the seating protrusion inserted into the seating hole, and wherein an elastic part is mounted around the seating protrusion so that an impact caused by a collision between the retaining step and the seating protrusion is reduced.

* * * * *